United States Patent [19]

Kyan et al.

[11] Patent Number: 5,053,117

[45] Date of Patent: Oct. 1, 1991

[54] CATALYTIC DEWAXING

[75] Inventors: Chwan P. Kyan, West Deptford; Rene B. LaPierre, Medford; Hsin-Ju J. Wang, Cherry Hill, all of N.J.

[73] Assignee: Mobil Oil Corporation, Fairfax, Va.

[21] Appl. No.: 557,244

[22] Filed: Jul. 25, 1990

[51] Int. Cl.[5] ..... C10G 69/02

[52] U.S. Cl. ..... 208/58; 208/59; 208/111

[58] Field of Search ..... 208/58, 59, 111

[56] References Cited

U.S. PATENT DOCUMENTS

| | | | |
|---|---|---|---|
| 3,524,807 | 8/1970 | Lewis | 208/111 |
| 3,681,232 | 8/1972 | Egan | 208/59 X |
| 3,816,296 | 6/1974 | Haas et al. | 208/111 |
| 3,894,939 | 7/1975 | Garwood et al. | 208/111 |
| 4,229,282 | 10/1980 | Peters et al. | 208/111 |
| 4,251,676 | 2/1981 | Wu | 585/486 |
| 4,431,517 | 2/1984 | Nevitt et al. | 208/111 |
| 4,441,991 | 4/1984 | Dwyer et al. | 208/111 |
| 4,648,957 | 3/1987 | Graziani et al. | 208/58 |
| 4,935,120 | 6/1990 | Lipinski et al. | 208/59 |

*Primary Examiner*—Curtis R. Davis
*Assistant Examiner*—William C. Diemler
*Attorney, Agent, or Firm*—Alexander J. McKillop; Charles J. Speciale; Malcolm D. Keen

[57] ABSTRACT

An improved process for catalytically dewaxing low nitrogen content hydrocarbon oils, such as distilled hydrocracker bottoms which normally form by-product naphtha of variable, but poor octane quality. The improvement is achieved by doping the low nitrogen content oil with a small amount of high nitrogen content gas oil, resulting in a by-product naphtha having a clear research octane of about 90, which octane is relatively insensitive to adjustment of pour point during processing.

21 Claims, 2 Drawing Sheets

CATALYTIC DEWAXING

FIELD OF THE INVENTION

This invention is concerned with catalytic dewaxing. In particular, it is concerned with the catalytic dewaxing of a low nitrogen content hydrocarbon oil to directly convert it to low pour point fuel oil and, as by-product, high octane naphtha for blending into gasoline.

BACKGROUND OF THE INVENTION

Hydrocarbon conversion processes that utilize crystalline zeolite catalysts have become of considerable industrial importance during the last few decades. This is clear from both the large number of patents that were issued in this field, as well as from the number of scientific and trade papers that have been published. The crystalline zeolites are effective for a variety of hydrocarbon conversion processes, some of which are used in the petroleum industry, and others in processing petrochemicals.

Catalytic cracking and/or hydrocracking of petroleum stocks are processes of major importance, and were so regarded even before crystalline zeolite catalysts became known for these processes. Broadly speaking, the principle purpose of cracking and hydrocracking is to reduce the boiling point of the higher boiling fractions of a crude oil. The zeolite employed in this type of conversion process has a pore size sufficiently large to admit all or nearly all of the molecular components normally found in the feed. Such crystalline zeolites are referred to as "large pore size" molecular sieves, and they are generally stated to have a pore size of from about 8 to about 13 angstroms in diameter. Large pore size zeolites are represented by Zeolites X, Y and L. Because the interior regions of the large pore zeolites are accessible to bulky molecules such as highly branched paraffins, and to all but the most bulky substituted aromatics, the "molecular sieve" property of the zeolite plays a very small role in non-selective boiling point reduction by cracking and hydrocracking. See for example U.S. patents 3,140,249, 3,140,251, 3,140,252, 3,140,253, and 3,271,418, all of which are incorporated by reference for background purposes.

Catalytic dewaxing processes, in contrast with cracking processes that use large pore zeolites, require crystalline zeolites of intermediate pore size as catalyst, and critically depend on the molecular sieve properties of the zeolite. Although catalytic cracking with boiling point reduction also takes place in catalytic dewaxing, the pore size of the zeolite permits only linear and singly methyl-branched paraffins (i.e., the waxes) to enter the interior regions of the crystal where they are cracked to lighter hydrocarbon by-products. These byproducts, principally $C_1$–$C_4$ hydrocarbons and naphtha, are readily separated from the remaining, less volatile "dewaxed" oil. In brief, catalytic dewaxing can be considered to be a relatively mild, shape selective cracking process. It is shape selective because the intermediate pore size of the catalyst inherently converts only the long, thin wax molecules to normally liquid or gaseous hydrocarbons. It is mild because the conversion of the gas oil feed to lower boiling range products is small, e.g. usually below about 35 percent and more normally below about 25 percent. It is operative over a wide temperature range but is usually carried out at relatively low temperatures, e.g. start of run temperatures of about 520° F. are usual.

U.S. Pat. No. 3,700,585 discloses and claims the cracking of paraffinic materials from various hydrocarbon feedstocks by contacting such feedstock with a ZSM-5 type zeolite at about 554° F. to 1312° F., at about 0.5 to 200 LHSV (Liquid Hourly Space Velocity) and in some cases with a hydrogen atmosphere. This patent is based upon work on dewaxing gas oils (particularly virgin gas oils) and crudes although its disclosure and claims are applicable to dewaxing any mixture of straight chain and slightly branched chain and other configuration hydrocarbons. The catalyst may have a hydrogenation/dehydrogenation component incorporated therein. Other U.S. patents teaching dewaxing of various petroleum stocks are U.S. Pat. No. Re. 28,398; U.S. Pat. Nos. 3,852,189; 3,891,540; 3,894,933; 3,894,938; 3,894,939; 3,926,782; 3,956,102; 3,968,024; 3,980,550; 4,067,797 and 4,192,734. The foregoing patents are incorporated herein by reference for background purposes.

U.S. Pat. No. 4,446,007 to F.A. Smith describes an improved hydrodewaxing process wherein an intermediate pore size zeolite is used as catalyst, and in which the high hydrogen consumption and low octane of the naphtha characteristic of the line-out period are improved by raising the reactor temperature in a prescribed manner prior to line out. U.S. Pat. No. 4,247,388 to Banta et al. describes treating ZSM-5 type zeolites to adjust their initially high alpha value (such as by steaming) prior to use as dewaxing catalyst. The treatment improves catalyst performance. U.S. Pat. No. 4,251,676 to M.M. Wu describes an improved process for selective cracking of 1,4-disubstituted aromatic compounds wherein the reactor feed is mixed with ammonia or an organic amine to increase the yield of recyclable olefin cracking product. U.S. Pat. No. 3,816,296 to Haas et al. describes selectively producing midbarrel fuels boiling between 300° and 700° F. from higher boiling feeds containing less than 10 ppm nitrogen, by hydrocracking in the presence of added nitrogen compounds corresponding to 5 to 100 ppm nitrogen. U.S. Pat. No. 3,524,807 to C.T. Lewis describes selectively hydrocracking, with increased yield of heavy naphtha, by maintaining the feed nitrogen content within the range of 25–75 ppm.

Hydrocracked oils that are waxy may be catalytically dewaxed to reduce pour point. Such oils typically contain very little nitrogen and have the advantage that they can be dewaxed at somewhat higher space velocity and with longer cycle life than more conventional gas oil feeds. However, such feeds often produce a naphtha of poor octane number, typically a clear research octane in the low eighties, during both the early transient period and even after the dewaxing unit has lined out. In addition, the octane of the naphtha, after line out, is pourpoint sensitive i.e. with increasing dewaxing severity (pour point from 0° to about −30° F.), the naphtha octanes decrease from about 93 to about 86. Compared with the dewaxed fuel oil, the naphtha by-product is a minor product, representing 3.5 to about 5.1 wt% based on charge, but may be higher for waxier feeds. (See Table III below.) The naphtha represents nonetheless a very valuable by-product of a dewaxing plant.

We now find that doping the low-nitrogen content dewaxable feed with a small amount of a high nitrogen content gas oil and dewaxing the resulting blend to the target pour point produces a light naphtha by-product which has a high research octane number, usually at least about 90, and which may be directly blended into the gasoline pool. Additionally, the octane of the naphtha produced in the presence of dopant is no longer pour point sensitive. This uncoupling of pour point and naphtha octane allows the refiner greater freedom in pour point control. As will be illustrated by example herein below, these improvements can be obtained with only a small proportion of dopant, under which conditions little or no decrease in catalyst activity is observed. This is an unexpected result.

SUMMARY OF THE INVENTION

An improved catalytic process for dewaxing a waxy hydrocarbon oil feed characterized by a low nitrogen content and a boiling point of about 330° F.+, said process comprising contacting said feed and hydrogen gas under dewaxing conditions with a catalyst comprising a crystalline aluminosilicate zeolite having a Constraint Index of 1 to about 12 and a silica to alumina ratio greater than 12 whereby forming a dewaxed effluent and recovering from said dewaxed effluent a low pour-point hydrocarbon oil and by-product naphtha of poor octane number, the improvement comprising cofeeding with said waxy hydrocarbon feed an amount of high nitrogen content gas oil sufficient to increase the total nitrogen content of the combined feed to about 65 to 500 ppm by weight thereby directly forming from said combined feed a dewaxed effluent containing high octane by-product naphtha; and, recovering said high octane by-product naphtha.

DESCRIPTION OF SPECIFIC EMBODIMENTS

The known catalytic dewaxing processes that are benefited by the improvement of the present invention, such as the MDDW process described below, are those:

a) that require an intermediate pore size shape-selective zeolite exemplified by ZSM-5 be used as the dewaxing catalyst; and, it is further required;

b) that if the low pour dewaxed oil formed in the dewaxing reactor is to be hydrotreated, it is necessary that the naphtha by-product be recovered before hydrotreating the dewaxed oil.

Figure 1:
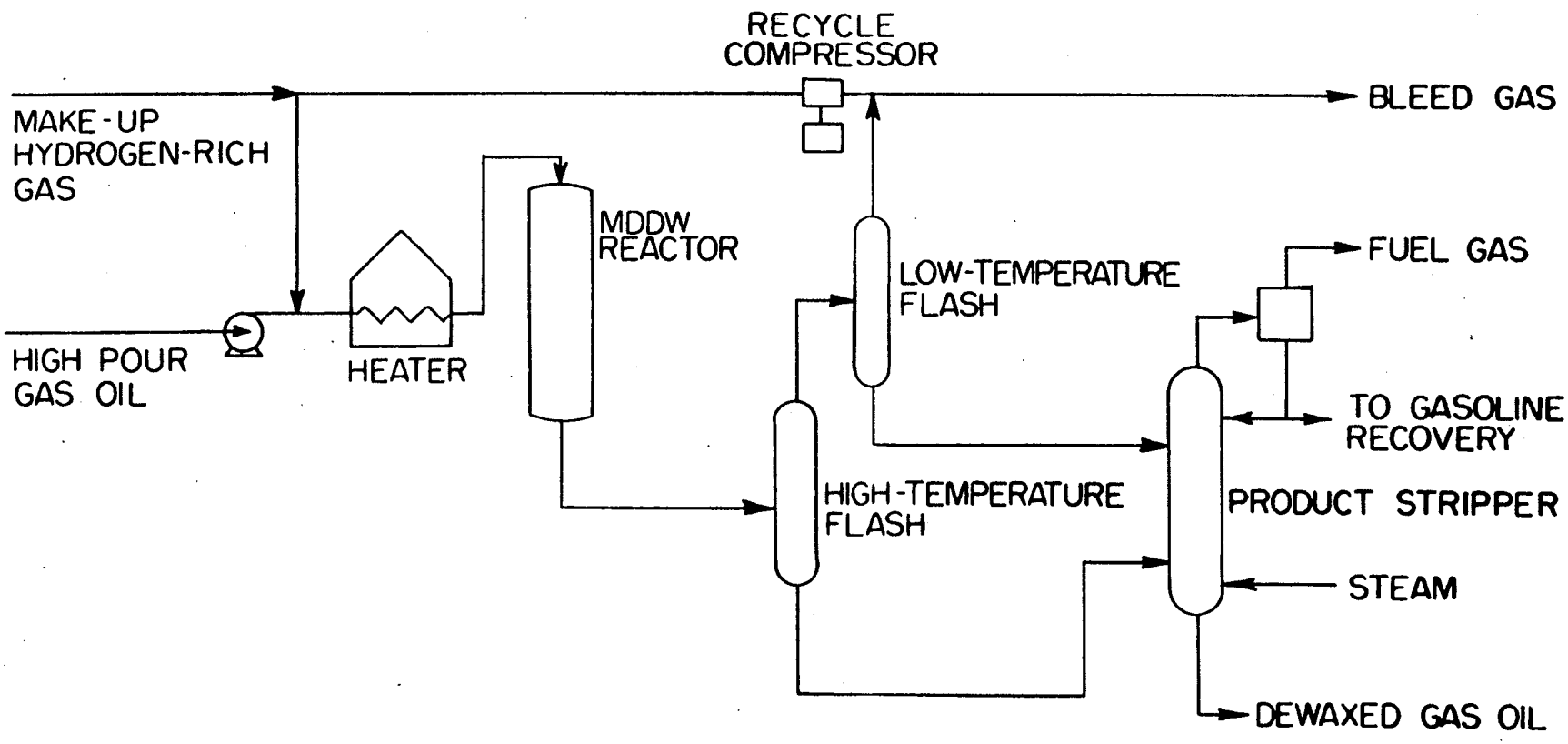
FIG. 1. Flowsheet of MDDW process.

A commercially used catalytic dewaxing process has become known as the MDDW process, the acronym "MDDW" signifying "Mobil Distillate Dewaxing". This process is described, for example, by N.Y. Chen et al. in "Shape Selective Catalysis in Industrial Applications", pp. 175–190, Marcel Dekker, Inc., New York and Basel, (1989), incorporated herein by reference for background purposes. FIG. 1 of the drawing, contained in that reference, is a flow sheet for a typically configured process consisting of a single fixed-bed, downflow, isothermal catalytic reactor with downstream separation and hydrogen recycle facilities. Fresh catalyst (or regenerated catalyst) usually is brought on stream at about 400° -500° F., and the reactor temperature is increased as needed to produce a target pour product. The temperature initially increases fairly rapidly until a line-out temperature is reached, after which only modest increases are needed periodically. Long operating cycles (6 months to 1 year) between regenerations are typical.

The feedstocks commonly used in the MDDW process Consist of hydrocarbon oil distillates, usually atmospheric or vacuum petroleum gas oils boiling about 330° F.+. The feeds typically have a high total nitrogen content, in the range of about 400 to 1000 ppm by weight or higher, and tend to be relatively aromatic. The term "high nitrogen content" as used herein means a total nitrogen content of at least about 200 ppm by weight. The improvement of the present invention applies to utilizing a low nitrogen content feed such as MPHC (Moderate Pressure Hydrocracker Bottoms) illustrated in Table III, column B, below. The expression "low nitrogen content feed" as used herein means a feed having a total nitrogen content substantially less than 100 ppm by weight, preferably not more than 50 ppm by weight and most preferably not more than about 30 ppm by weight. It is contemplated that the feed may have as little as about 1 ppm total nitrogen, and that in general the lower the nitrogen content within the limits indicated, the greater will be the improvement effected by the present invention. The method of doping the low nitrogen content feed with the high nitrogen content feed is not believed to be critical, and may be effected by simply cofeeding the two materials upstream of the dewaxing reactor inlet in proportions required to provide about 65 to 500 ppm by weight of total nitrogen in the blended feed, and more preferably about 65 to 150 ppm by weight of total nitrogen. Any of the above described gas oil feedstocks for the MDDW process may be used as high nitrogen feed, the preferred ones having 400–1000 ppm total nitrogen.

The conversion conditions generally useful in the present invention are those which apply to the MDDW process and these are shown in Table I.

TABLE I

DEWAXING CONDITIONS: GENERAL

| | Broad | Preferred |
|---|---|---|
| Temperature, °F. | 400–900 | 550–800 |
| LHSV, $hr^{-1}$ | 0.25–4.0 | 0.5–2.0 |
| Total Pressure, psig | 200–3500 | 400–3000 |
| $H_2$ Circulation, scf/bbl | 1500–10,000 | 2500–5000 |

A particular variant of the MDDW process is the MLDW (Mobil Lube Dewaxing) process. This process, too, is in commercial use, and it is designed to produce high quality, low pour point lubes. The process differs from the MDDW process in that the broad dewaxing temperature range is 400° to 725° F. (instead of 400° to 900° F.), with a preferred temperature range of 500° to 675° F. (instead of 550° to 800° F.). Other processing conditions are the same as those shown in Table I. Another difference is that the MLDW process uses a two-reactor system. The effluent from the first reactor contains the ZSM-5 type catalyst, and the total dewaxed effluent from this reactor is cascaded to the second reactor which contains a hydrotreating catalyst. Because the hydrotreating catalyst will hydrogenate the olefinic components with adverse effects on the octane number of the subsequently recovered naphtha, it is contemplated that the benefits of the present invention applied to MLDW are best obtained by separating and recovering the naphtha from the dewaxer effluent prior to the hydrotreating step. Modifications of MLDW in which separation of the naphtha prior to hydrotreating the dewaxed lube oil are known and described in U.S. patents 4,648,957 and 4,695,364 to Graziani et al., incorporated herein by reference as if fully set forth in order to convey those teachings.

It is contemplated that the improved results of this invention are obtained with MDDW Operated within the parameters described in Table I, usually to produce fuel oils, and that these improved results will be obtained, although to a somewhat lesser degree, in manufacturing high quality lubricants by the modified MLDW process described above.

The shape-selective zeolite useful as dewaxing catalyst has an effective pore size of about 5 to about 8 angstroms, such as to freely sorb normal hexane. In addition, the structure must provide constrained access to larger molecules. It is sometimes possible to judge from a known crystal structure whether such constrained access exists. For example, if the only pore windows in a crystal are formed by 8-membered rings of silicon and aluminum atoms, then access by molecules of larger cross-section than normal hexane is excluded and the zeolite is not of the desired type. Windows of 10-membered are preferred, although, in some instances, excessive puckering of the rings or pore blockage may render these zeolites ineffective.

Although 12-membered rings in theory would not offer sufficient constraint to produce advantageous conversions, it is noted that the puckered 12-ring structure of TMA offretite, ZSM12 and Zeolite Beta do show some constrained access. Other 12-ring structures may exist which may be operative for other reasons, and therefore, it is not the present intention to entirely judge the usefulness of the particular zeolite solely from theoretical structural considerations.

A convenient measure of the extent to which a zeolite provides controlled access to molecules of varying sizes to its internal structure is the Constraint Index (CI) of the zeolite. Zeolites which provide a highly restricted access to and egress from its internal structure have a high value for the Constraint Index, and zeolites of this kind usually have pores of small size, e.g. less than 5 angstroms. On the other hand, zeolites which provide relatively free access to the internal zeolite sructure have a low value for the constraint Index, and usually have pores of large size, e.g. greater than 8 angstroms. The method by which Constraint Index is determined is described fully in U.S. Pat. No. 4,016,218, incorporated herein by reference for details of the method.

Constraint Index (CI) values for some typical materials (some of which are outside the scope of the present invention) are:

| | CI | (at test temperature) |
|---|---|---|
| ZSM-4 | 0.5 | (316° C.) |
| ZSM-5 | 6-8.3 | (371° C.-316° C.) |
| ZSM-11 | 5-8.7 | (371° C.-316° C.) |
| ZSM-12 | 2.3 | (316° C.) |
| ZSM-20 | 0.5 | (371° C.) |
| ZSM-22 | 7.3 | (427° C.) |
| ZSM-23 | 9.1 | (427° C.) |
| ZSM-34 | 50 | (371° C.) |
| ZSM-35 | 4.5 | (454° C.) |
| ZSM-38 | 2 | (510° C.) |
| ZSM-48 | 3.5 | (538° C.) |
| ZSM-50 | 2.1 | (427° C.) |
| TMA Offretite | 3.7 | (316° C.) |
| TEA Mordenite | 0.4 | (316° C.) |
| Clinoptilolite | 3.4 | (510° C.) |
| Mordenite | 0.5 | (316° C.) |
| REY | 0.4 | (316° C.) |
| Amorphous Silica-alumina | 0.6 | (538° C.) |
| Dealuminized Y | 0.5 | (510° C.) |

-continued

| | CI | (at test temperature) |
|---|---|---|
| Erionite | 38 | (316° C.) |
| Zeolite Beta | 0.6-2.0 | (316° C.-399° C.) |

The above-described Constraint Index is an important and even critical definition of those zeolites which are useful in the instant invention. The very nature of this parameter and the recited technique by which it is determined, however, admit of the possibility that a given zeolite can be tested under somewhat different conditions and thereby exhibit different Constraint Indices. Constraint Index seems to vary somewhat with severity of operations (conversion) and the presence or absence of binders. Likewise, other variables, such as crystal size of the zeolite, the presence of occluded contaminants, etc., may affect the Constraint Index. Therefore, it will be appreciated that it may be possible to so select test conditions, e.g. temperature, as to establish more than one value for the Constraint Index of a particular zeolite. This explains the range of Constraint Indices for some zeolites, such as ZSM-5, ZSM-11 and Beta.

It is to be realized that the above CI values typically characterize the specified zeolites, but that such values are the cumulative result of several variables useful in the determination and calculation thereof. Thus, for a given zeolite exhibiting a CI value within the range of 1 to 12, depending on the temperature employed during the test method within the range of 290° C. to about 538° C., with accompanying conversion between 10% and 60%, the CI may vary within the indicated range of 1 to 12. Likewise, other variables such as the crystal size of the zeolite, or the presence of possibly occluded contaminants and binders intimately combined with the zeolite, may affect the CI. It will accordingly be understood to those skilled in the art that the CI, as utilized herein, while affording a highly useful means for characterizing the zeolites of interest, is approximate, taking into consideration the manner of its determination, with the possibility, in some instances, of compounding variable extremes. However, in all instances, at a temperature within the above-specified range of 290° C. to about 538° C., the CI will have a value for any given zeolite of interest herein within the approximate range of 1 to 12.

The class of highly siliceous zeolites defined herein is exemplified by ZSM-5, ZSM-11, ZSM-12, ZSM-23, ZSM-35, ZSM-38, ZSM 48, and other similar materials.

U.S. Pat. No. 3,702,886 describing and claiming ZSM-5 is incorporated herein by reference.

ZSM-11 is more particularly described in U.S. Pat. No. 3,709,979, the entire content of which is incorporated herein by reference.

ZSM-12 is more particularly described in U.S. Pat. No. 3,832,449, the entire content of which is incorporated herein by reference.

ZSM-23 is more particularly described in U.S. Pat. No. 4,076,842, the entire content of which is incorporated herein by reference.

ZSM-35 is more particularly described in U.S. Pat. No. 4,016,245, the entire content of which is incorporated herein by reference.

ZSM-38 is more particularly described in U.S. Pat. No. 4,046,859, the entire content of which is incorporated herein by reference.

The specific zeolites described, when prepared in the presence of organic cations, are substantially catalytically inactive, possibly because the intra-crystalline free space is occupied by organic species from the forming solution. These organic templates are removed by heating in an inert atmosphere at 1000° F. for one hour, for example, followed by base exchange with ammonium salts followed by calcination at 1000° F. in air.

The ZSM-5 type zeolites referred to herein have a crystal framework density, in the dry hydrogen form, of not less than about 1.6 grams per cubic centimeter. The dry density for known crystal structures may be calculated from the number of silicon plus aluminum atoms per 1000 cubic Angstroms, as given, e.g., on Page 19 of the article on Zeolite Structure by W. M. Meier. This paper, the entire contents of which are incorporated herein by reference, is included in "Proceedings of the Conference on Molecular Sieves, London, April 1967," published by the Society of Chemical Industry, London, 1968. When the crystal structure is unknown, the crystal framework density may be determined by classical pycnometer techniques. For example, it may be determined by immersing the dry hydrogen form of the zeolite in an organic solvent not sorbed by the crystal. Or, the crystal density may be determined by mercury porosimetry, since mercury will fill the interstices between crystal but not the zeolitic pores themselves.

EXAMPLES

The following examples are given for illustrative purposes only, and are not to be construed as limiting in any way the scope of the present invention.

All of the experiments reported below were conducted with a single fixed-bed, down-flow, isothermal reactor. The feedstock was contacted with a 1/16' Ni-ZSM-5 steamed extrudate dewaxing catalyst. The catalyst was prepared from a base of 65% ZSM-5 type zeolite mixed with 35% hydrated alumina (alpha alumina monohydrate). The base was then dried and calcined in $N_2$ at 1000° F. to decompose organic material. Then, the base was exchanged at room temperature with an aqueous solution of ammonium nitrate ($NH_2NO_3$) to reduce sodium levels in the zeolite to less than 500 ppm. This reduced sodium material was impregnated with nickel components by contact with an aqueous solution of nickel nitrate ($Ni(NO_3)_2.6H_2O$). The resulting composite was dried out and calcined at 1000° F. and the final product contained about 1.3 wt% nickel. Experimental conditions were: 550° -780° F. reactor temperature, 1-2 LHSV, 385 psig ($H_2$), 2000 SCF/B $H_2$ circulation. All charge and product lines were heat-traced at about 150° F. to prevent plugging by waxy components. An on-line atmospheric still separated the total liquid product into an overhead naphtha and a bottoms (about 330° F.+) stream. The still bottom was maintained at 600° -650° F. to achieve an overhead temperature of 150° -200° F. with 50% reflux. Light gases from the still were combined with the off-gas for on-line GC analysis and for flow rate measurement through a wet-test meter. Overhead naphtha and still bottoms were submitted for product yield and property analyses.

Figure 2:
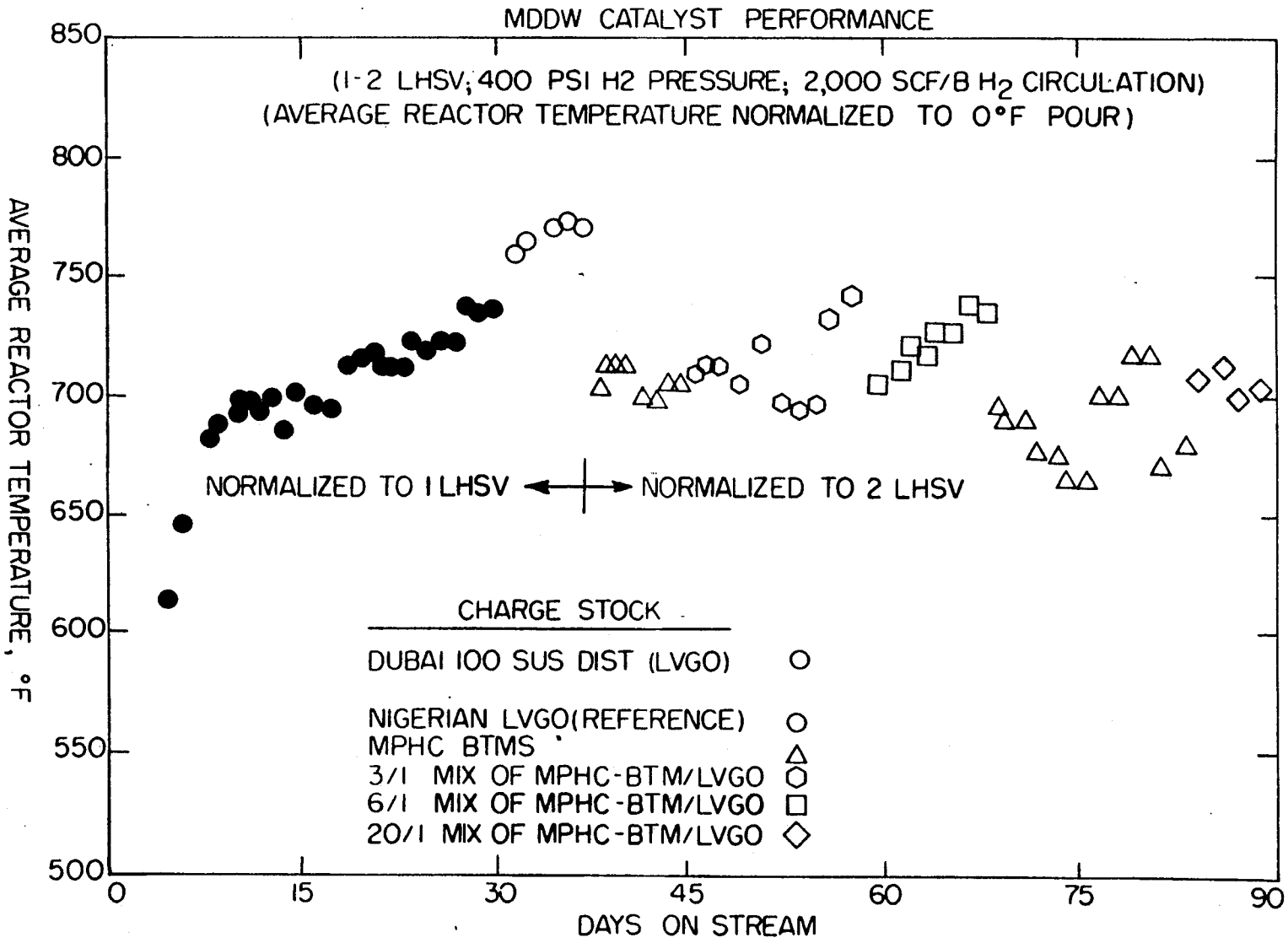
FIG. 2. Catalyst Line-Out and History.

The unit was started up using standard MDDW pilot plant procedures. Following sulfiding at 500° F. with 2% $H_2S$ in $H_2$ at 500 psig, the reactor was lined out at 500° F., 385 psig, and 2000 SCF/B $H_2$ flow rate. Then, the Dubai LVGO was charged to the unit with reactor temperature raised initially at 10° F./hour to 550° F. Afterwards, the reactor temperature was adjusted by monitoring distillation bottoms product pour point every 12 hours to maintain around the target pour. After a 10-15 day transient period, material balances were taken at lined-out conditions to define product yields and properties. FIG. 2 shows the start up and line out of the catalyst, and sequence of feeds used.

Table I lists the properties of the pilot plant feedstocks. These feedstocks contain about 8 wt% wax, which will dictate the naphtha and distillate yields. The Nigerian LVGO was a reference MDDW feedstock which was used to confirm the catalyst performance. The sequence in which these feedstocks were processed and the on-stream time for each are shown in FIG. 1.

EXAMPLES 1-2 (Prior Art)

Balance runs were made for the unmodified Dubai stock at lined-out conditions for 1.5 LHSV, and for the hydrocracked bottoms at 2.0 LHSV. The results are shown in Table III. As can be seen from the data, the clear research octane of the naphtha from the straight hydrocracker bottoms is about five octane units less than for the naphtha from straight Dubai LVGO.

EXAMPLES 3-4

In these examples, balance runs were made for a 3/1 volumetric blend of the hydrocracker bottoms and the Dubai LVGO at lined-out conditions for 2 LHSV. The severity was somewhat different, producing a pour point of −15° F. in Example 3, and 0° F. in Example 4. In both instances the octanes of the two naphthas was about 4 to 5 units higher than for the straight hydrocracker bottoms feed (Example 2), and about the same as for the straight Dubai LVGO feed (Example 1).

EXAMPLES 5-6

These examples are similar to Examples 3-4 except that a 6/1 volumetric blend of hydrocracker bottoms and Dubai LVGO was used instead of a 3/1 volumetric blend. The results are similar to those of Examples 3-4, i.e., a small proportion of the high nitrogen feed added to the low nitrogen hydrocracker bottoms dramatically increases the RON of the naphtha without a significant decrease in catalyst activity.

TABLE II

MDDW PILOT PLANT FEEDSTOCK PROPERTIES

| | A. Dubai Lt. Vac. Gas Oil | B. MPHC BTMS Gas Oil | C. 3/1 Mix MPHC BTMS & Dubai LVGO | D. 6/1 Mix MPHC BTMS & Dubai LVGO |
|---|---|---|---|---|
| Properties | | | | |
| API Gravity | 22.6 | 32.0 | 30.3 | |
| Specific Gravity @ 16° C. | 0.918 | 0.865 | 0.8745 | |
| Molecular Weight | 331 | 399 | 386 | 387 |
| Sulfur, wt % | 2.5 | 0.025 | 0.66 | 0.4 |
| Nitrogen, ppmw | 960 | 21 | 250 | 155[1] |

TABLE II-continued

| MDDW PILOT PLANT FEEDSTOCK PROPERTIES | A. Dubai Lt. Vac. Gas Oil | B. MPHC BTMS Gas Oil | C. 3/1 Mix MPHC BTMS & Dubai LVGO | D. 6/1 Mix MPHC BTMS & Dubai LVGO |
|---|---|---|---|---|
| Basic Nitrogen, ppmw | 338 | 5 | 88 | |
| Hydrogen, wt % | 12.45 | 14.02 | 13.66 | |
| Carbon Residue by MCRT, wt % | 0.02 | 0.11 | 0.08 | 0.09 |
| Aniline Point, °F./°C. | 159/70 | 224/107 | 253/123 | — |
| Flash Point, °F./°C. | 403/206 | 421/216 | 403/206 | 378/192 |
| Bromine Number | 7.4 | 0.68 | 2.18 | |
| Total Acid Number | <0.05 | 0.16 | | |
| Extract in Pet. Waxes, wt % | 92.7 | 91.8 | 91.5 | |
| Kinematic Vis. @ 40° C., cs | 24.45 | 45.31 | 38.55 | |
| Kinematic Vis. @ 100° C., cs | 4.232 | 5.788 | 5.90 | |
| Refractive Index @ 70° C. | 1.4916 | 1.461 | 1.468 | 1.465 |
| Composition by MS, wt % | | | | |
| Paraffins | 23.7 | | 35.4 | |
| Naphthenes | 24.0 | | 35.0 | |
| Aromatics | 52.3 | | 29.6 | |
| Fluidity, °F./°C. | | | | |
| Pour Point | 60/16 | 90/32 | | |
| Distillation, °F./°C. | D-1160 | D-1160-1 | | |
| IBP | 606/319 | 604/318 | | |
| 5 Vol. % Distilled | 664/351 | 662/350 | | |
| 10 Vol. % Distilled | 682/361 | 687/364 | | |
| 30 Vol. % Distilled | 726/386 | 767/408 | | |
| 50 Vol. % Distilled | 756/402 | 840/449 | | |
| 70 Vol. % Distilled | 783/417 | 924/496 | | |
| 90 Vol. % Distilled | 811/433 | 1033/556 | | |
| 95 Vol. % Distilled | 824/440 | 1080/582 | | |
| EP | 841/449 | 1115/602 | | |

[1](Calculated)

TABLE III

| RESULTS FROM CO-FEEDING | Example No. | | | | | |
|---|---|---|---|---|---|---|
| | Ex. 1 | Ex. 2 | Ex. 3 | Ex. 4 | Ex. 5 | Ex. 6 |
| | Pure Feed | | Co-feeding | | Co-feeding | |
| Days On Stream | 25.1 | 42.4 | 47.4 | 48.9 | 59.4 | 62.9 |
| Feed | Dubai LVGO | MPHC-BTM | 3/1 Mix MPHC-BTM/LVGO | | 6/1 Mix MPHC-BTM/LVGO | |
| LHSV | 1.5 | 2.0 | 2.0 | 2.0 | 2.0 | 2.0 |
| Avg. Reactor Temp., °F. | 740 | 710 | 729 | 700 | 701 | 720 |
| Yields, wt % on charge: | | | | | | |
| $C_1$-$C_4$ | 5.0 | 4.8 | 4.1 | 3.4 | | |
| Naphtha (Nominal $C_5$-330° F.) | 5.1 | 4.0 | 4.4 | 3.4 | | |
| Distillate (Nominal 330° F.+) | 89.6 | 90.0 | 91.3 | 92.9 | | |
| $H_2$ Consumption, SCF/B | −120 | −100 | −100 | −145 | | |
| Unstabilized Naphtha Properties: | | | | | | |
| Specific Gravity @ 60° F. | 0.673 | 0.678 | 0.681 | 0.683 | | 0.677 |
| Sulfur, wt % | ~0.08 | 0.01 | 0.01 | 0.01 | | 0.01 |
| Mercaptan, ppm | ~195 | — | 92 | 98 | | |
| Mini RON-clear | 93.1 | 88.2 | 93.3 | 92.6 | 94.1 | 93.9 |
| Paraffins | 35.9 | 41 | 26.8 | | | |
| Olefins | 58.7 | 43 | 68.0 | | | |
| Naphthenes | 4.8 | 12 | 3.9 | | | |
| Aromatics | 0.6 | 4 | 1.3 | | | |
| Distillate Properties: | | | | | | |
| °API | 21.2 | 30.7 | 28.2 | 28.8 | 29.6 | 31.2 |
| Analytical Pour Point, °F. | 0 | −20 | −15 | 0 | +10 | 0 |
| Cloud Point, °F. | — | — | — | — | — | — |
| Flash Point, °F. | 299 | 345 | — | 302 | — | — |
| Sulfur, wt % | 2.5 | 0.03 | 0.7 | 0.7 | 0.4 | 0.4 |
| N, ppm | 1100 | 25 | 300 | 300 | 250 | 260 |
| KV @ 40° C. | 22.8 | 34.13 | 30.99 | 29.97 | 28.70 | 28.78 |
| @ 100° C. | 3.84 | 5.78 | 5.22 | 5.17 | 5.07 | 5.06 |

What is claimed is:

1. In a catalytic process for dewaxing a waxy lubricating oil stock boiling in the range of about 450° F.+ and selected from the group consisting of a low nitrogen content deasphalted raffinate, distilled hydrocracker bottoms, and mixtures thereof, said process comprising:

contacting said waxy stock and hydrogen gas with a catalyst comprising a crystalline aluminosilicate zeolite having a Constraint Index of 1 to about 12 and a silica to alumina ratio greater than 12, said contacting being conducted under a combination of conditions including a temperature of 400° to about 725° F., a LHSV of 0.25 to about 4.0, a total pressure of 200 to about 3500 psig, and a hydrogen circulation of 1500 to about 10,000 scf/bbl, said combination being effective to form an effluent consisting of a dewaxed lubricating oil stock and low octane olefinic by-product naphtha; and, hydrotreating said effluent prior to recovering said dewaxed lubricating oil stock and low octane by-product naphtha, the improvement comprising:

cofeeding a small amount of high nitrogen content gas oil with said waxy stock, said amount being sufficient to increase the total nitrogen content of the combined feed to about 65 to 500 ppm by weight and thereby directly form a dewaxed effluent containing low pour point lubricating oil and high octane olefinic by-product naphtha from said combined feed;

recovering said high octane by-product olefinic naphtha prior to said hydrotreating step; and, hydrotreating only the dewaxed lubricating oil.

2. The process described in claim 1 wherein the total nitrogen of the combined feed is about 65 to 150 ppm by weight, and said crystalline aluminosilicate zeolite has the crystal structure of ZSM-5.

3. The process described in claim 1 wherein said waxy lubricating oil feed is distilled hydrocracker bottoms, and said crystalline aluminosilicate zeolite has the crystal structure of ZSM-5.

4. The process described in claim 2 wherein said waxy lubricating oil feed is distilled hydrocracker bottoms.

5. The process described in claim 3 wherein said dewaxing temperature is about 500° to 675° F.

6. A method for catalytically dewaxing a waxy hydrocarbon oil feed having a nitrogen content of not more than about 65 ppm by weight to directly convert it to a low pour point fuel oil and high octane by-product naphtha, which method comprises:

doping said low nitrogen content waxy oil feed whereby forming a blend containing not less than about 65 ppm by weight of nitrogen;

contacting said blend under dewaxing conditions with a catalyst comprising a crystalline zeolite having a Constraint Index of 1 to about 12 and a silica to alumina ratio greater than aboutout 12 thereby forming a dewaxed effluent; and, recovering low pour point fuel oil and high octane byproduct naphtha from said dewaxed effluent.

7. The method of claim 6 wherein said crystalline zeolite has the crystal structure of ZSM-5.

8. In a catalytic process for dewaxing a waxy hydrocarbon oil feed characterized by a low nitrogen content and a boiling point of about 330° F.+, said process comprising contacting said feed and hydrogen gas under dewaxing conditions with a catalyst comprising a crystalline aluminosilicate zeolite having a Constraint Index of 1 to about 12 and a silica to alumina ratio greater than 12 whereby forming a dewaxed effluent and recovering from said dewaxed effluent a low pour-point hydrocarbon oil and by-product naphtha of poor octane number, the improvement comprising:

cofeeding with said waxy hydrocarbon feed an amount of high nitrogen content gas oil sufficient to increase the total nitrogen content of the combined feed to about 65 to 500 ppm by weight thereby directly forming from said combined feed a dewaxed effluent containing high octane by-product naphtha; and, recovering said high octane by-product naphtha.

9. The process described in claim 8 wherein said low nitrogen content hydrocarbon oil feed is a vacuum distilled fraction of hydrocracker bottoms.

10. The process described in claim 8 wherein said conversion conditions include a temperature of about 400° to about 900° F., a LHSV of 0.25 to about 4.0, a total pressure of 200 to about 3500 psig, and a hydrogen circulation rate of about 1500 to about 10,000 scf/bbl.

11. The process described in claim 9 wherein said conversion conditions include a temperature of about 400° to about 900° F., a LHSV of 0.25 to about 4.0, a total pressure of 200 to about 3500 psig, and a hydrogen circulation rate of about 1500 to about 10,000 scf/bbl.

12. The process described in claim 9 wherein said conversion conditions include a temperature of about 550° to 800° F., a LHSV of 0.5 to about 2.0, a total pressure of 400 to about 3000 psig, and a hydrogen circulation of about 2500 to about 5000 scf/bbl.

13. The process described in claim 8 wherein said combined feed has a total nitrogen content of about 65 to about 150 ppm by weight.

14. The process described in claim 9 wherein said combined feed has a total nitrogen content of about 65 to about 150 ppm by weight.

15. The process described in claim 8 wherein said crystalline aluminosilicate zeolite has the crystal structure of ZSM-5.

16. The process described in claim 9 wherein said crystalline aluminosilicate zeolite has the crystal structure of ZSM-5.

17. The process described in claim 11 wherein said crystalline aluminosilicate zeolite has the crystal structure of ZSM-5.

18. The process described in claim 10 wherein said crystalline aluminosilicate zeolite has the crystal structure of ZSM-5.

19. The process described in claim 12 wherein said crystalline aluminosilicate zeolite has the crystal structure of ZSM-5.

20. The process described in claim 13 wherein said crystalline aluminosilicate zeolite has the crystal structure of ZSM-5.

21. The process described in claim 14 wherein said crystalline aluminosilicate zeolite has the crystal structure of ZSM-5.

* * * * *